US011614239B2

(12) United States Patent
Goessler et al.

(10) Patent No.: US 11,614,239 B2
(45) Date of Patent: Mar. 28, 2023

(54) VAPOUR EXTRACTION DEVICE

(71) Applicant: Wilhelm BRUCKBAUER, Neubeuern (DE)

(72) Inventors: Siegfried Goessler, Bad Aibling (DE); Daniel Neunhaeuserer, Neustift (AT); Alexander Schadeck, Aschau i. Chiemgau (DE); Mario Blersch, Brannenburg (DE); Walter Koenneker, Rosenheim (DE)

(73) Assignee: Wilhelm BRUCKBAUER, Neubeuern (DE)

( * ) Notice: Subject to any disclaimer, the term of this patent is extended or adjusted under 35 U.S.C. 154(b) by 164 days.

(21) Appl. No.: 16/753,294

(22) PCT Filed: Sep. 10, 2018

(86) PCT No.: PCT/EP2018/074282

§ 371 (c)(1),
(2) Date: Apr. 2, 2020

(87) PCT Pub. No.: WO2019/068421

PCT Pub. Date: Apr. 11, 2019

(65) Prior Publication Data

US 2020/0333018 A1 Oct. 22, 2020

(30) Foreign Application Priority Data

Oct. 6, 2017 (DE) ..... 102017217853.1

(51) Int. Cl.
*F24C 15/20* (2006.01)
*F24C 15/10* (2006.01)

(52) U.S. Cl.
CPC ..... *F24C 15/2042* (2013.01); *F24C 15/2035* (2013.01); *F24C 15/10* (2013.01); *F24C 15/2021* (2013.01); *F24C 15/2085* (2013.01)

(58) Field of Classification Search
CPC ..... F24C 15/2042; F24C 15/2035; F24C 15/10; F24C 15/2021; F24C 15/2085; F24C 15/07; F24C 7/06; A47J 37/06
See application file for complete search history.

(56) References Cited

U.S. PATENT DOCUMENTS 6,455,818 B1 9/2002 Arntz et al.
8,872,077 B2 * 10/2014 Gagas ..... H05B 6/1209 219/623

(Continued)

FOREIGN PATENT DOCUMENTS

DE 102004058390 A1 6/2006
DE 202007018342 U1 7/2008

(Continued)

OTHER PUBLICATIONS

"International Search Report" dated Nov. 19, 2018, issued in corresponding PCT Application No. PCT/EP2018/74282, Filed Sep. 10, 2018, Entitled: "Vapour Extraction Device".

(Continued)

*Primary Examiner* — Jason Lau
(74) *Attorney, Agent, or Firm* — Perry + Currier, Inc.

(57) ABSTRACT

The invention relates to a vapour extraction device for extracting cooking vapours downward. The vapour extraction device comprises a fan apparatus for sucking in the cooking vapours having a fan impeller which can be driven in rotation, a fan motor for supplying a drive torque, and a releasable fan coupling for transmitting the drive torque to the fan impeller.

17 Claims, 8 Drawing Sheets

(56) References Cited

U.S. PATENT DOCUMENTS

| | | | | |
|---|---|---|---|---|
| 10,006,641 | B2 * | 6/2018 | Bruckbauer | F24C 15/2035 |
| 10,549,227 | B2 * | 2/2020 | Adam | F24C 15/2042 |
| 10,712,019 | B2 * | 7/2020 | Adam | F24C 15/14 |
| 10,782,030 | B2 * | 9/2020 | Gargiulo | F24C 15/2071 |
| 10,900,665 | B2 * | 1/2021 | Flesch | F24C 15/2035 |
| 2008/0210102 | A1 | 9/2008 | Rabas | |
| 2009/0178578 | A1 * | 7/2009 | Valentine | F24C 15/322 219/400 |
| 2014/0048057 | A1 * | 2/2014 | Bruckbauer | F24C 15/2035 126/299 D |
| 2016/0177972 | A1 * | 6/2016 | Santucci | F04D 29/624 417/423.14 |
| 2019/0162421 | A1 * | 5/2019 | Cimino | F24C 15/2042 |
| 2019/0195511 | A1 * | 6/2019 | Neunhauserer | F24C 15/2035 |
| 2021/0148580 | A1 * | 5/2021 | Bussotto | F24C 15/2035 |

FOREIGN PATENT DOCUMENTS

| | | | |
|---|---|---|---|
| DE | 102009003957 | A1 | 3/2010 |
| DE | 202011005698 | U1 | 11/2011 |
| DE | 102012216288 | A1 | 3/2013 |
| EP | 3133349 | A1 | 2/2017 |
| EP | 3133350 | A1 | 2/2017 |
| JP | 2970799 | B2 | 11/1999 |
| WO | 2014079568 | A2 | 5/2014 |

OTHER PUBLICATIONS

"Examination Report", dated Mar. 14, 2018, issued in corresponding German Application No. 10 2017 217 853.1, filed Oct. 6, 2017.

* cited by examiner

VAPOUR EXTRACTION DEVICE

CROSS-REFERENCE TO RELATED APPLICATIONS

This application claims the priority of German Patent Application Serial No. DE 10 2017 217 853.1, filed on Oct. 6, 2017, pursuant to 35 U.S.C. 119(a)-(d), the content of which is incorporated herein by reference in its entirety as if fully set forth herein.

FIELD OF THE INVENTION

The invention relates to a vapour extraction device. The invention is moreover based on a stovetop system.

BACKGROUND OF THE INVENTION

A vapour extraction device for extracting cooking vapours is disclosed below from EP 3 133 349 A1. The vapour extraction device comprises a fan apparatus with a fan impeller which can be driven in rotation and is attached to a fan motor. During operation of the vapour extraction device, cooking vapours flow through the fan apparatus, wherein it is not possible to completely prevent liquid and solid constituents of the cooking vapours from also coming into contact with the fan impeller and being deposited there. The performance of the fan impeller can be reduced as a result of it becoming contaminated and it can become a breeding ground for harmful organisms.

An object of the invention is to improve a vapour extraction device.

This object is achieved by a vapour extraction device for extracting cooking vapours downward, comprising an extraction duct for conduction the cooking vapours and a fan apparatus for sucking in the cooking vapours having a fan impeller which can be driven in rotation and can be arranged in the extraction duct, a fan motor for supplying a drive torque, and a releasable fan coupling for transmitting the drive torque to the fan impeller, wherein the fan impeller can e removed from the extraction duct via an inflow opening. According to the invention, it has been recognized that a drive torque can be transmitted to the fan impeller via a releasable fan coupling. The fan impeller can thus be reversibly coupled to the fan motor. The fan impeller can in particular be removed reversibly from a fan motor. As a result, it is advantageously achieved that the fan impeller can be cleaned particularly easily, in particular in a dishwasher. The performance of the fan apparatus can thus be preserved and a breeding ground for harmful organisms can be prevented from being created on the fan impeller.

SUMMARY OF THE INVENTION

According to one aspect of the invention, the vapour extraction device comprises the fan apparatus and an extraction duct. The extraction duct can have a reduced-pressure duct section with an inflow opening. The extraction duct is preferably designed to differentiate a region of the extraction device which conducts the cooking vapours from a region which does not come into contact with the cooking vapours, in particular below a stovetop panel. The extraction duct preferably has a fan housing. The fan housing can have a housing opening and an exhaust opening. The housing opening can be designed as a suction opening. The reduced-pressure duct section can be connected liquid-tightly to a fan housing, in particular to a housing opening of the fan housing. Cooking vapours can thus be conducted, via the inflow opening along the reduced-pressure duct section, via the housing opening, into the fan housing.

In plan view, the inflow opening can have a round, in particular a circular, or a polygonal, in particular a rectangular design. The inflow opening is preferably arranged centrally above the fan impeller. Particularly preferably, the inflow opening is arranged concentrically with an axis of rotation of the fan impeller. A geometric center of gravity of the area of the inflow opening can also be arranged at a distance from the axis of rotation in plan view.

The vapour extraction device can have one or more fan apparatuses. A plurality of fan impellers which can be driven in rotation can also be arranged inside the fan housing.

A drive shaft of the fan motor is preferably arranged concentrically with the axis of rotation. Alternatively, the drive shaft of the fan motor can also be arranged at a distance from the axis of rotation. The drive shaft can be connected to the fan coupling directly or indirectly, for example via a drive belt. By virtue of the spaced-apart arrangement of the fan motor, it is advantageously achieved that the structural space occupied by the vapour extraction device can be reduced, in particular vertically.

The fan motor can be arranged at a distance from the region directly below the inflow opening. Safety during operation can be increased thereby.

The motor can in particular be arranged in a region of the vapour extraction device which is protected from liquid which might possibly penetrate through the inflow opening.

The motor can generally be arranged at a distance from the fan impeller. As a result, the structural space which is required overall for the vapour extraction device can be reduced further.

The motor can in particular be arranged in a direction perpendicular to the axis of rotation at a distance from the fan impeller. The distance apart can hereby be at least as great as the diameter of the fan impeller. The distance apart can in particular be at least 10 cm, in particular at least 20 cm, in particular at least 30 cm. It is preferably no more than 100 cm, in particular no more than 50 cm, in particular no more than 40 cm. In this case, the distance apart is understood to be in particular the distance between the axis of rotation of the fan impeller and the fan motor, in particular the drive shaft thereof.

The fan motor can also be arranged aligned with the fan impeller. The drive shaft of the fan motor can in particular be arranged coaxially with the axis of rotation of the fan impeller. The motor can in this case be arranged in particular in the direction of the axis of rotation, offset with respect to the fan impeller.

According to a further aspect of the invention, the fan impeller is coupled directly to the motor, in particular the drive shaft thereof. It can preferably also be coupled contactlessly to the motor.

According to an alternative, the fan impeller is coupled indirectly to the fan motor.

According to an aspect of the invention, the fan motor is connected to the fan impeller via a gearing mechanism and/or a belt drive. This enables a particularly flexible arrangement relative to the fan impeller. The motor can in particular be arranged at the same height as the fan impeller.

According to a further aspect of the invention, the motor can directly or indirectly drive a direction-changing means, in particular in the form of a direction-changing shaft or a direction-changing roller. One or more fan impellers can be driven via the direction-changing means. For this purpose, in each case a belt drive or a gearing mechanism, in particular a shiftable gearing mechanism, can, for example, be provided.

It is thus possible to drive one, two, three, or more fan impellers with a single fan motor. The individual fan impellers can hereby preferably be driven separately from one another. As a result, the flexibility of the vapour suction is further enlarged.

According to an aspect of the invention, the vapour extraction device has at least one fan motor which is connected in each case to at least two, in particular at least three, of the fans so as to drive them in rotation. All of the fans are preferably driven in rotation by means of a single fan motor.

According to a further aspect, for this purpose the fan motor can be connected, so as to transmit rotation, to the respective fan impeller of the at least one fan, in particular to at least two, and in particular to at least three fans, via a rotation-transmitting means, in particular a gearing mechanism and/or a belt drive.

An axis of rotation of the at least one fan motor is preferably oriented parallel to an axis of rotation of the fan impeller, in particular to the axes of rotation of all the fan impellers.

The axes of rotation of the at least one fan motor and the at least three fans can be oriented vertically.

The axis of rotation of the at least one fan motor can be arranged offset with respect to the axis of rotation of the at least three fans.

The at least one fan motor preferably overlaps at least one, in particular all, of the fans, in particular the fan impellers thereof, which are connected thereto in the direction of its axis of rotation, i.e. in a projection perpendicular to its axis of rotation. The motor can in particular be arranged at the same height as the fan impeller or impellers. The vapour extraction device can thus be configured to be particularly compact in the direction of the axis of rotation of the at least one fan motor and/or the at least three fans.

The total structural height of the vapour extraction device can be less than 25 cm, in particular no more than 20 cm, in particular no more than 15 cm, in particular no more than 11 cm, in particular no more than 8 cm, in particular no more than 5 cm. The lower limit for the structural height of the vapour extraction device is a result of the height of the fan impeller, i.e. of the extent of the fan impeller in the direction of its axis of rotation.

A vapour extraction device with the at least three fans with a vertical axis of rotation and the fan motor, arranged next to said fans and overlapping in the vertical direction and with a vertical axis of rotation can be arranged below a stovetop in a particularly compact fashion. A space above and/or below the at least three fans is thus as far as possible available as storage space.

The fan motor can be attached directly or via a motor flange to the stovetop panel or to a housing for a stovetop heating system. It is advantageously ensured that the fan motor is fastened in a particularly space-saving and torsion-resistant manner.

The fan impeller can preferably be cleaned by hand. The fan impeller is preferably designed so that it is free of burrs. Corners and edges of the fan impeller can be rounded. The fan blades of the fan impeller are preferably spaced apart from one another in such a way that the gaps formed between them are no smaller than 5 mm at any point. The distance between adjacent fan blades is in particular at least 10 mm, in particular at least 15 mm. Easy cleaning of the fan impeller is enabled as a result.

The fan impeller can take the form of a radial fan. The axis of rotation of the fan impeller is preferably oriented vertically. It is advantageously ensured as a result that the fan impeller can be integrated into the fan apparatus in a particularly space-saving manner.

The fan impeller can alternatively also take the form of an axial fan.

The fan coupling can preferably be released by hand, in particular without using tools. The fan coupling can alternatively also be released by means of a tool or by means of an in particular electrical or purely mechanical drive element.

The fan coupling is preferably arranged between the fan impeller and the fan motor. The fan coupling can have a drive-side driving component and a driven-side driven component. The driven component can be connected to the fan motor, in particular to the drive shaft. The driving component preferably takes the form of a drive pin. The driven component can be connected to the fan impeller. The driven component preferably takes the form of a drive bell housing. The driven component can be connected to the driving component non-rotatably and so that it can be shifted along the axis of rotation. The driving component and the driven component preferably interact in an interlocking fashion for the purpose of transmitting the drive torque, in particular in the form of a feather key connection or a splined shaft connection or a polygonal shaft connection or serrations. It is advantageously ensured as a result that the drive torque around the axis of rotation can be transmitted efficiently to the fan impeller, wherein the fan impeller can be detached from the fan motor along the axis of rotation.

The interlocking connection for the purpose of transmitting the drive torque can have a helical gearing. The interlocking connection is preferably configured spirally with respect to the axis of rotation. The direction of rotation of the helically geared or spiral connection can be configured in such a way that a force results from the transmitted drive torque which closes the fan coupling, acts in particular in the direction of the axis of rotation, and in particular presses the driven component onto the driving component.

The fan impeller is preferably arranged, in particular completely, in the fan housing. The fan motor can be arranged partially or completely outside the extraction duct or a region through which cooking vapours pass. All the live and electronic components of the fan motor are preferably arranged outside the fan housing. The drive shaft of the fan motor can penetrate the fan housing. The fan coupling is preferably arranged inside the extraction duct, in particular of the fan housing, or the region through which cooking vapours pass, wherein the driving component is rigidly attached to the drive shaft. It can be ensured as a result that sensitive and/or live components of the fan motor are protected from contamination and liquid which can enter the extraction duct or the region through which cooking vapours pass.

According to an aspect of the invention, the fan impeller can be removed reversibly from the extraction duct. The fan impeller can be removed from the extraction duct or the region through which the cooking vapours pass via the housing opening. For this purpose, the fan impeller can have an external diameter which is smaller than the lowest dimension or the diameter of the housing opening. Alternatively, the fan housing can have a removal opening which can be sealed in particular by a sealing cover and via which the fan impeller can be removed. The fan impeller can be removed from the extraction duct via the removal opening vertically upward or downward or horizontally. It is advantageously ensured as a result that the fan impeller can be removed particularly easily and can be cleaned in particular in a dishwasher.

The fan impeller can be removed from the extraction duct, in particular through the inflow opening, by a purely translational movement. Alternatively, the fan impeller can also be removed from the extraction duct, in particular through the inflow opening, by a combined translational and rotational movement, in particular by tilting it about a horizontal axis. The extraction duct, in particular the inflow opening, can be designed for example in such a way that the fan impeller can be removed from the extraction duct, in particular through the inflow opening, in an orientation which is inclined with respect to its installed situation and is inclined in particular at 90° with respect to a horizontal axis. A cross-section of the inflow opening and/or an inner cross-section of the extraction duct, in particular of the reduced-pressure duct section, which conducts the cooking vapours, is preferably dimensioned in such a way that it completely covers a longitudinal section and/or a cross-section of the fan impeller. The fan impeller can thus be removed from the extraction duct, in particular through the inflow opening and/or through the reduced-pressure duct section, in any orientation. The extraction duct, in particular the inflow opening and/or the reduced-pressure duct section, can thus have a cross-sectional surface area which is smaller than the cross-sectional surface area of the fan impeller. The extraction duct can accordingly be designed in a particularly space-saving manner.

According to an aspect of the invention, the fan impeller can be removed from the extraction duct without using tools. The fan impeller can also preferably be inserted into the vapour extraction device without using tools. For this purpose, the extraction duct, in particular the reduced-pressure duct section, can be dimensioned such that the fan impeller can be removed through it, in particular by hand. The fan coupling can preferably be released by hand. It is advantageously ensured as a result that the fan impeller can be removed from the extraction duct particularly easily.

According to another aspect of the invention, the fan impeller can be removed via the inflow opening of the extraction duct. The housing opening and/or the reduced-pressure duct section and/or the inflow opening can be dimensioned relative to the fan impeller such that the latter can be removed from the fan housing and the extraction duct. The fan impeller can be removed, for example, from the fan housing and the extraction duct in a tilted position. The external diameter of the fan impeller can also be dimensioned such that it is smaller than the diameter of the housing opening. The external diameter of the fan impeller can furthermore be dimensioned such that it is smaller than the smallest dimension of a cross-section, in particular than a smallest internal diameter, of the reduced-pressure duct section. The external diameter of the fan impeller can furthermore be dimensioned such that it is smaller than an internal diameter of the inflow opening. It is thereby advantageously ensured that the fan impeller can be removed from the fan housing via the housing opening, the reduced-pressure duct section, and the inflow opening. The stovetop system, in particular the vapour extraction device, can hereby moreover remain completely installed. It is in particular not necessary to open the fan housing or the system housing of the stovetop system in order to remove the fan impeller.

According to a further aspect of the invention, the fan coupling is a magnetic coupling. The fan coupling is preferably designed as a contactless magnetic coupling. The fan coupling can here be designed such that the drive torque is transmitted contactlessly to the fan impeller via a wall of the extraction duct, in particular of the fan housing. Such an arrangement has the advantage that only the fan impeller is arranged inside the fan housing and live components can be arranged outside the fan housing. These live components, in particular the fan motor, are thus protected from contamination and liquids. It is in particular possible to arrange a wall of the region through which cooking vapours pass, in particular of the extraction duct, between the motor and the fan impeller.

The fan motor preferably takes the form of a brushless external fan motor. A stator of the fan motor, which comprises live windings, can here be arranged outside the fan housing. A rotor of the fan motor, which has permanent magnets, can be attached to the fan impeller. The releasable fan coupling for transmitting the drive torque to the fan impeller is here formed between the stator and the rotor. The drive torque is transmitted by means of alternating magnetic fields. The brushless external fan motor thus itself forms the fan coupling. It is advantageous that, by virtue of the brushless transmission of the drive torque, live components can be reliably protected from contamination and liquids, in particular by being arranged outside the fan housing.

According to an aspect of the invention, the fan coupling has a locking means which can move between a release position and a locking position. The locking means can be activated without using tools. The locking means can take the form of a locking bolt with axial retaining means. Such a socket bolt can have pins or balls which protrude radially beyond a shaft of the socket bolt in a locking position and hence ensure an interlocking connection in the axial direction. The locking means can be arranged between the driving component and the driven component. Displacement of the driven component along the axis of rotation relative to the driving component is thus prevented. By activating a push button, in particular a spring-loaded one, the socket bolt can be shifted into a release position. In the release position, the balls or pins are withdrawn into the shaft of the socket bolt and do not protrude from it. The driven component can thus be released from the driving component. It is advantageously ensured as a result that the fan coupling can be sealed securely and reliably. By virtue of being able to activate the locking means without using tools, it can be shifted into the release position particularly easily.

The locking means can also take the form of a shaft nut or a spring connector or a cotter pin or a snap ring. As a result, the fan coupling can be sealed along the axis of rotation particularly effectively.

The fan coupling can have a centering means for coaxially orienting the fan impeller with respect to the axis of rotation. The centering means can take the form of a centering pin and a centering bore or a centering seat with a flat, in particular conical bearing surface. The concentricity of the fan impeller can thus be improved.

According to an aspect of the invention, the fan coupling has a magnetic connection. The magnetic connection can be arranged between the driven component and the driving component. The driven component is preferably reversibly fastened on the driving component, in particular in the direction of the axis of rotation, via the magnetic connection. The magnetic connection preferably has at least one magnet which is attached to the driving component and interacts with at least one magnet attached to the driven component or with a ferromagnetic material. Alternatively, the magnetic connection can also have at least one magnet which is attached to the driven component and interacts with a ferromagnetic material attached to the driving component. The magnets can take the form of permanent magnets or electromagnets. The fan coupling is thus securely sealed, in particular in the axial direction, and can be released particularly easily, in particular without using tools.

According to an aspect of the invention, the fan apparatus has a collecting tray for holding liquids. The collecting tray can be arranged below the fan impeller. The collecting tray is preferably arranged between the fan impeller and the fan housing. The collecting tray can have a capacity of at least 25 ml, in particular at least 50 ml, in particular at least 100 ml, in particular at least 200 ml, in particular at least 300 ml, in particular at least 500 ml. It is advantageously ensured as a result that contamination and liquids are deposited essentially in the collecting tray and not in the fan housing.

The collecting tray can preferably be removed from the fan housing. The collecting tray can preferably also be removed from the extraction duct. The collecting tray can thus be cleaned particularly easily. The collecting tray can be designed so that it is dishwasher-safe. The collecting tray is preferably manufactured from a dishwasher-safe material, in particular from a corrosion-resistant material, in particular from a rust-free material, preferably from plastic.

According to another aspect of the invention, the collecting tray is attached to the fan impeller. The fan impeller can be removed from the extraction duct together with the collecting tray. The fan impeller and the collecting tray can also be removed separately from the vapour extraction device.

The fan impeller can preferably be removed together with the collecting tray from the extraction duct, in particular from the housing opening and/or the inflow opening. The collecting tray can be mounted so that it can rotate relative to the fan impeller. The collecting tray is connected non-rotatably to the fan housing. As a result, contamination can be prevented from being thrown out of the collecting tray owing to centrifugal forces when the fan impeller is driven in rotation.

According to another aspect of the invention, the fan impeller is dishwasher-safe. The fan impeller can be manufactured from a dishwasher-safe material, in particular a corrosion-resistant material, in particular from a rust-free material. The fan impeller is preferably manufactured from a metal or a plastic. The fan impeller can also have an anti-corrosion coating. Burrs have been removed from the fan impeller and it is rounded in particular in the region of the edges and corners. As a result, wounds can be avoided when the fan impeller is removed.

The fan impeller preferably has a weight of no more than 1 kg, in particular no more than 500 g, in particular no more than 300 g, in particular no more than 200 g. It is thus very light.

This helps to make it easier to remove the fan impeller. Moreover, the operational reliability is increased as a result. Should a fan impeller fall down, damage and/or wounds are in particular prevented.

According to another aspect of the invention, the vapour extraction device has a protective grating arranged upstream from the fan impeller for the purpose of protecting against people reaching into the fan impeller. The protective grating can be attached reversibly to the vapour extraction device, in particular to a protective grating seat of the vapour extraction device. The protective grating can be attached in the reduced-pressure duct section, in particular in its center. It is advantageously ensured as a result that the protective grating does not protrude from the extraction duct. Alternatively, the protective grating can be attached within the plane of the inflow opening or above it. Preferably, the border collar has the protective grating seat. The protective grating can thus be attached to the border collar. The protective grating can be attached in the region of the inflow opening or above it. As a result, the cooking vapours can be guided via the vertical extent of the extraction duct. The cooking vapours can thus be sucked away in the immediate vicinity of where they are created.

The protective grating can be detached from the protective grating seat, in particular upward, in particular in a vertical direction. The protective grating can also be pivoted into a release position. For this purpose, the protective grating can be connected to the protective grating seat in a hinged fashion. Alternatively, the protective grating can be guided displaceably in the protective grating seat and in particular be mounted parallel to the stovetop panel. It is advantageously ensured as a result that the protective grating can be moved between a locking and a release position without there being any need for it to be removed completely from the vapour extraction device.

The protective grating preferably completely covers the reduced-pressure duct section and/or the inflow opening. The protective grating can have round, in particular circular, or rectangular, in particular square, flow openings for the passage of the cooking vapours. The flow openings are preferably dimensioned such that it is not possible for someone to reach through with their hands or fingers. Wounds to the hands or the fingers by reaching through into the rotating fan impeller can thus be reliably prevented.

According to another aspect of the invention, the protective grating has a grease filter insert. The grease filter insert can be attached to the protective grating. Alternatively, the protective grating can take the form of a grease filter insert. The number of parts can advantageously be reduced thereby and/or a particularly compact structure can be obtained.

According to another aspect of the invention, the fan apparatus has a sealing means for sealing the fan motor liquid-tightly with respect to the extraction duct of the vapour extraction device. It is advantageously ensured as a result that liquid which enters the extraction duct through the inflow opening cannot penetrate as far as the fan motor. The electronic components of the fan motor are thus protected from damage, in particular caused by short-circuits.

The sealing means can take the form of a shaft sealing ring, in particular a radial and/or axial shaft sealing ring. The sealing means can be arranged between the drive shaft of the fan motor and the extraction duct, in particular the fan housing. The extraction duct, and in particular the fan housing, is preferably sealed from the drive shaft in the region between the fan motor and the fan coupling.

According to another aspect of the invention, the vapour extraction device has a circuit breaker connected to an energy supply of the fan motor. Preferably, when the circuit breaker is activated, the operation of the fan motor can be interrupted and/or the rotational movement of the fan impeller can be halted. It is advantageously ensured as a result that the energy supply to the fan motor is interrupted in order to protect the operator from being wounded or the rotational movement of the fan impeller is decelerated, and in particular is halted.

The circuit breaker preferably takes the form of a light barrier. The circuit breaker can be arranged upstream from the fan impeller. By virtue of attaching such a circuit breaker upstream, it can be avoided that people can reach into the active fan impeller by the light barrier being interrupted as soon as a person reaches into the inflow opening or into the extraction duct, as a result of which the rotational movement of the fan impeller can be halted.

Alternatively, the circuit breaker can also be a window toggle switch or a smoke detector or a temperature sensor or a pressure sensor. It can advantageously be ensured as a result that simultaneous operation of the fan motor and a heating chamber, in particular a stove, is permitted only when there is no risk of smoke from the heating chamber being sucked in by the vapour extraction device.

The circuit breaker can also take the form of a push button or a magnetic switch or a distance sensor. The circuit breaker is preferably signal-linked to a control unit for the purpose of controlling the vapour extraction device. It is advantageously ensured as a result that, when the circuit breaker is activated, the energy supply to the fan motor can be interrupted and/or a deceleration program for rapidly decelerating the fan motor can be initiated.

According to another aspect of the invention, the circuit breaker is configured to detect the attachment of the protective grating to the protective grating seat. When the protective grating is not attached to the protective grating seat, the operation of the fan motor can be interrupted. The circuit breaker can be attached to an underside of the stovetop panel or to the outside of the extraction duct. The circuit breaker can be attached in the protective grating seat in the form of a push button or in the form of a distance sensor. It is advantageously ensured as a result that the circuit breaker can be reliably activated when the protective grating is not attached to the protective grating seat.

According to another aspect of the invention, the fan housing has a fan housing projection. The fan housing projection can be arranged above the housing opening. The grease filter insert can be attached to the fan housing projection via a filter carrier. The grease filter insert preferably has at least one side wall which is permeable to cooking vapours and/or a base region which is permeable to cooking vapours.

The filter carrier can have a carrier seat for holding the grease filter insert. The filter carrier is preferably configured to be permeable to cooking vapours in a central region, in particular inside the carrier seat. In a region of the filter carrier which is situated outside the carrier seat when viewed from above, said filter carrier can likewise be configured to be permeable to cooking vapours. The filter carrier preferably has at least three, in particular at least four, in particular at least six carrier feet via which it is attached to the fan housing. It is advantageously ensured as a result that cooking vapours can be sucked both through the at least one side wall of the grease filter insert and past the filter seat, and also through the base region of the grease filter insert and through the central opening in the filter carrier. The filter effect is improved owing to the large surface area of the grease filter insert through which the cooking vapours flow. An upper edge of the grease filter insert is here connected to the reduced-pressure duct section gas-tightly.

According to another aspect of the invention, the grease filter insert can be integrally connected to the protective grating. It is advantageously ensured as a result that the grease filter insert can be removed from the extraction duct particularly easily.

The filter carrier can have a carrier tray for holding liquid in its outer edge region when viewed from above. Liquid which penetrates can thus be collected in the carrier tray between the grease filter insert and the extraction duct.

The grease filter insert can be designed with a tubular, in particular cylindrical, in particular circular cylindrical shape. The side walls of the grease filter insert are here preferably configured to be permeable to cooking vapours. The grease filter insert can be connected gas-tightly to the filter carrier. The protective grating can be attached to the grease filter insert. An inflow gap can be configured between the protective grating and the edge of the inflow opening. The inflow gap can at least partially surround the protective grating when viewed from above. The protective grating can here be configured to be gas-tight. Cooking vapours can thus be sucked into the fan housing via the inflow gap, through the side walls of the grease filter insert, in particular from outside to the inside and through the filter carrier.

The filter carrier, in particular together with the grease filter insert, can preferably be removed from the extraction duct, in particular from the reduced-pressure duct section, and through the inflow opening.

A further object of the invention consists in improving a stovetop system.

This object is achieved by a stovetop system with at least one vapour extraction device according to the preceding description and at least one stovetop with at least one cooking zone for heating food. The advantages follow from those of the vapour extraction device.

According to an aspect of the invention, the stovetop system can take the form of an assembly unit. The at least one vapour extraction device and the at least one stovetop are preferably attached to a common carrier frame and/or are connected by a common system housing. By virtue of the design of the stovetop system as an assembly unit, the assembly complexity can be considerably reduced when inserting the stovetop system into a kitchen work surface. Difficulties in installation and damage during assembly can be reduced.

The stovetop system can have a particularly compact design. It can in particular have a particularly low structural height. The structural height of the stovetop system is in particular no more than 25 cm, in particular no more than 20 cm, in particular no more than 15 cm, in particular no more than 11 cm, and in particular no more than 8 cm. It has been shown that it can be 5 cm or less.

The stovetop system can have a modular construction. The at least one vapour extraction device and/or the at least one stovetop can here exist as separate modules which are not connected to one another when installed in the kitchen work surface. These separate modules can preferably be connected to one another via suitable mechanical and electronic interfaces. It is advantageously ensured that the stovetop system can have a particularly flexible design and can be adapted according to customer preferences.

BRIEF DESCRIPTION OF THE DRAWINGS

Other features, advantages, and details of the invention follow from the following description of the vapour extraction device and the stovetop system with the aid of the drawings.

DESCRIPTION OF THE PREFERRED EMBODIMENTS

Various details of a stovetop system 1 and a vapour extraction device 2 are described below with the aid of FIGS. 1 to 4.

Figure 1:
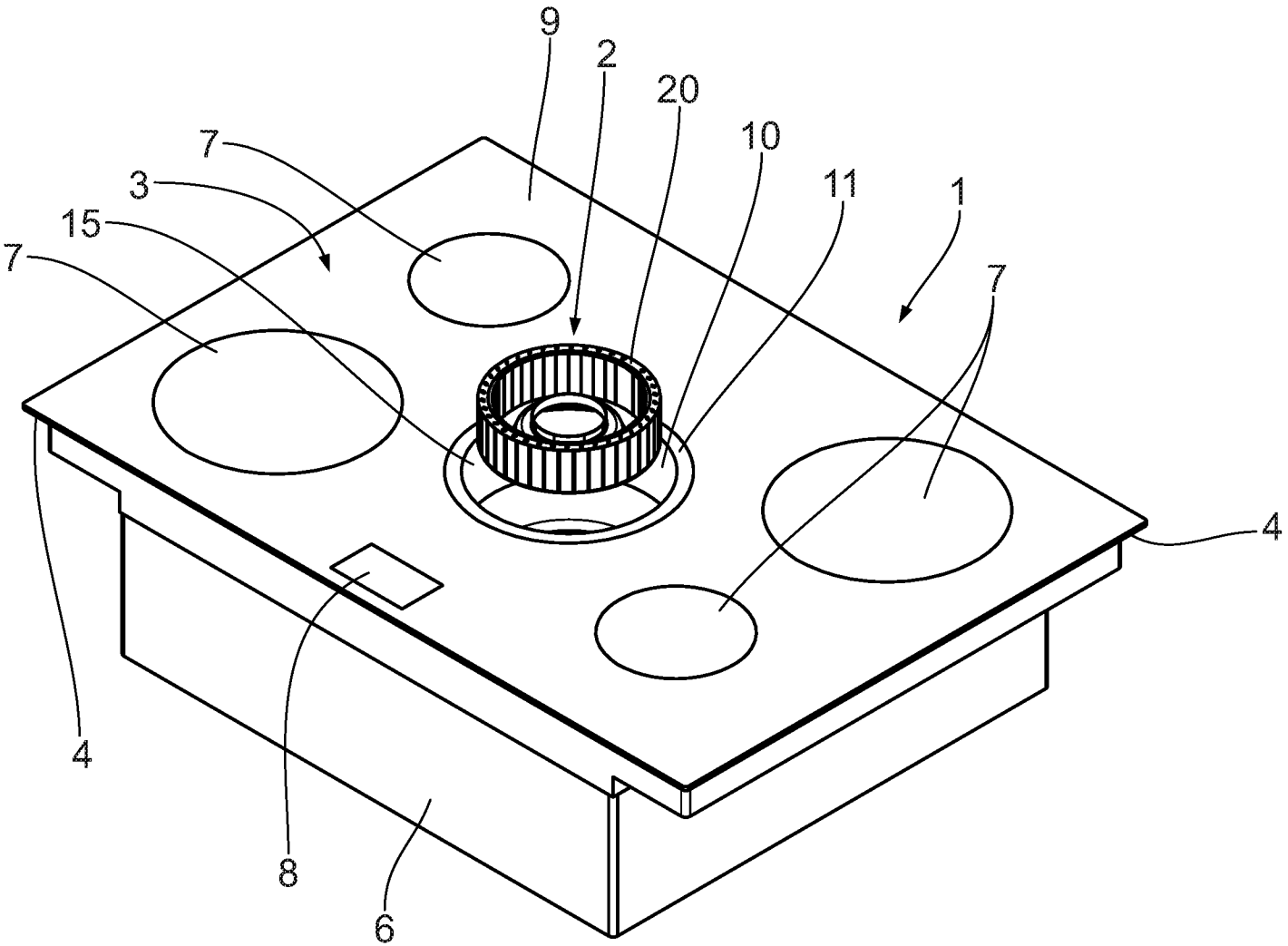
FIG. 1 shows a perspective view of a stovetop system with a stovetop and a vapour extraction device.

A stovetop system 1 is shown in FIG. 1 with a vapour extraction device 2 for extracting cooking vapours downward and a stovetop 3 for heating food. The stovetop system 1 takes the form of a compact assembly unit and has a fastening flange 4 for fastening to a kitchen work surface 5 and a system housing 6.

The stovetop comprises four cooking zones 7 and a control unit 8. Both the cooking zones 7 and the control unit 8 are arranged on a stovetop panel 9.

The stovetop panel 9 takes the form of a Ceran stovetop panel. The system housing 6 is adhesively bonded to the stovetop panel 9. The fastening flange 4 is formed by the edge region of the stovetop panel 9. The stovetop panel 9 rests on the kitchen work surface 5 from above. The stovetop panel 9 has an extraction opening 10 for the ingress of cooking vapours. The extraction opening 10 has a circular design when viewed from above and is arranged centrally with respect to the stovetop panel 9. The stovetop panel 9 has a circumferential border collar 11 at the edge of the extraction opening 10.

The control unit 8 is fastened on the system housing 6. The control unit 8 has touch-sensitive sensors (not shown) which can be operated via an upper side of the stovetop panel 9. The control unit 8 is signal-linked to the cooking zones 7.

The vapour extraction device 2 is arranged inside the system housing 6. The vapour extraction device 2 has an extraction duct 12 and a fan apparatus 13. The extraction duct 12 has a reduced-pressure duct section 14 which extends between the extraction opening 10 and the fan apparatus 13. The extraction duct 12 has an inflow opening 15 in order to suck the cooking vapours into it. The inflow opening 15 is covered by a protective grating 16. The protective grating 16 rests on the border collar 11. The protective grating 16 is permeable to cooking vapours and designed such that it prevents people from reaching into the reduced-pressure duct section 14.

A grease filter insert 17 is arranged in the reduced-pressure duct section 14. The grease filter insert 17 has an essentially cylindrical design. A grease filter collar 18 of the grease filter insert 17 is here connected liquid-tightly to the reduced-pressure duct section 14. The grease filter collar 18 is supported vertically from above on a duct projection 19. The grease filter insert 17 is designed to be dishwasher-safe.

The fan apparatus 13 comprises a fan impeller 20 which can be driven in rotation, a fan motor 21 for supplying a drive torque and a releasable fan coupling 22 for transmitting the drive torque to the fan impeller 20. The fan impeller 20 is arranged in a fan housing 23. The fan housing 23 is attached to the system housing 6.

The fan housing 23 has a housing opening 24 and an exhaust opening 24*a*. The reduced-pressure duct section 14 is connected liquid-tightly to the fan housing 23 in the region of the housing opening 24. The fan housing 23 is thus connected to the inflow opening 15 so that liquid can be conducted. The fan housing is connected to high-pressure duct section (not shown) via the exhaust opening 24*a* so that liquid can be conducted.

The housing opening 24 and the reduced-pressure duct section 14 have a circular design in cross-section. The housing opening 24, the reduced-pressure duct section 14, and the inflow opening 15 are configured such that the fan impeller 20 can be removed from the fan housing 23 and the extraction duct 12 via said housing opening 24, reduced-pressure duct section 14, and inflow opening 15. An external diameter D of the fan impeller is here smaller than the internal diameter of the housing opening 24, the reduced-pressure duct section 14, and the inflow opening 15. The grease filter insert 18 can be removed from the reduced-pressure duct section 14 and the protective grating 16 can be detached from the border collar 11.

The fan motor 21 is attached to the system housing 6. The fan motor 21 acts on the fan impeller 20 via the fan coupling 22 for the purpose of transmitting the drive torque. The fan coupling 22 comprises a driving component in the form of a drive pin 25 and a driven component in the form of a drive bell housing 26. The drive pin 25 is connected non-rotatably to a drive shaft (not shown) of the fan motor 21. The drive bell housing 26 is connected non-rotatably to the fan impeller 20. The fan coupling 22 has an interlocking profile in the form of a splined shaft connection for the purpose of transmitting the drive torque between the drive pin 25 and the drive bell housing 26. The drive pin 25 here takes the form of a splined shaft and the drive bell housing 26 takes the form of a splined hub.

The fan coupling 22 has a locking means 28 for the purpose of fastening the fan impeller 20 on the drive pin 25 along an axis of rotation 27. Pins 29 of the locking means 26 engage in a locking position in bores 30 of the drive bell housing 26. The fan impeller 20 is thus connected to the drive bell housing 26 in interlocking fashion along the axis of rotation 27.

A collecting tray 31 for holding liquid is arranged between the fan impeller 20 and the fan housing 23. The collecting tray 31 is connected non-rotatably to the fan housing 23. An external tray diameter W of the collecting tray 31 is here dimensioned such that the latter can be removed upward from the fan housing 23 and the extraction duct 12 through the housing opening 24, the reduced-pressure duct section 14, and the inflow opening 15.

The collecting tray 31 and the fan impeller 20 are designed to be dishwasher-safe. The collecting tray 31 and the fan impeller 20 are manufactured from a rust-free metal, deburred, and rounded at the corners and edges.

A circuit breaker 32 is arranged on the underside of the stovetop panel 9. The circuit breaker 32 is connected to an energy supply of the fan motor 21 via a signal link 33. The protective grating 16 is attached to a protective grating seat 34 formed by the border collar 11 and the reduced-pressure duct section 14. The circuit breaker 32 is configured to detect the attachment of the protective grating 16 to the protective grating seat 34. If the protective grating 16 is unattached to the protective grating seat 34, the operation of the fan motor 21 can be interrupted via the signal line 33.

A sealing means 33*a* is arranged between the drive shaft and the fan motor 21 and the fan housing 23. The sealing means 33*a* ensures a liquid-tight seal between the fan motor 21 and the fan housing 23 and the extraction duct 12. The sealing means 33*a* takes the form of a shaft sealing ring.

The stovetop system 1 functions as follows:

The individual cooking zones 7 and the fan motor 21 can be controlled by means of the control apparatus 8. An operator of the stovetop system 1 can activate or deactivate the cooking zones 7 and the fan motor 21 via the control unit 8, and adjust the power output via the cooking zones 7 and the fan motor 21. For this purpose, the control unit 8 is signal-linked to the cooking zones 7 and the fan motor 21.

Figure 2:
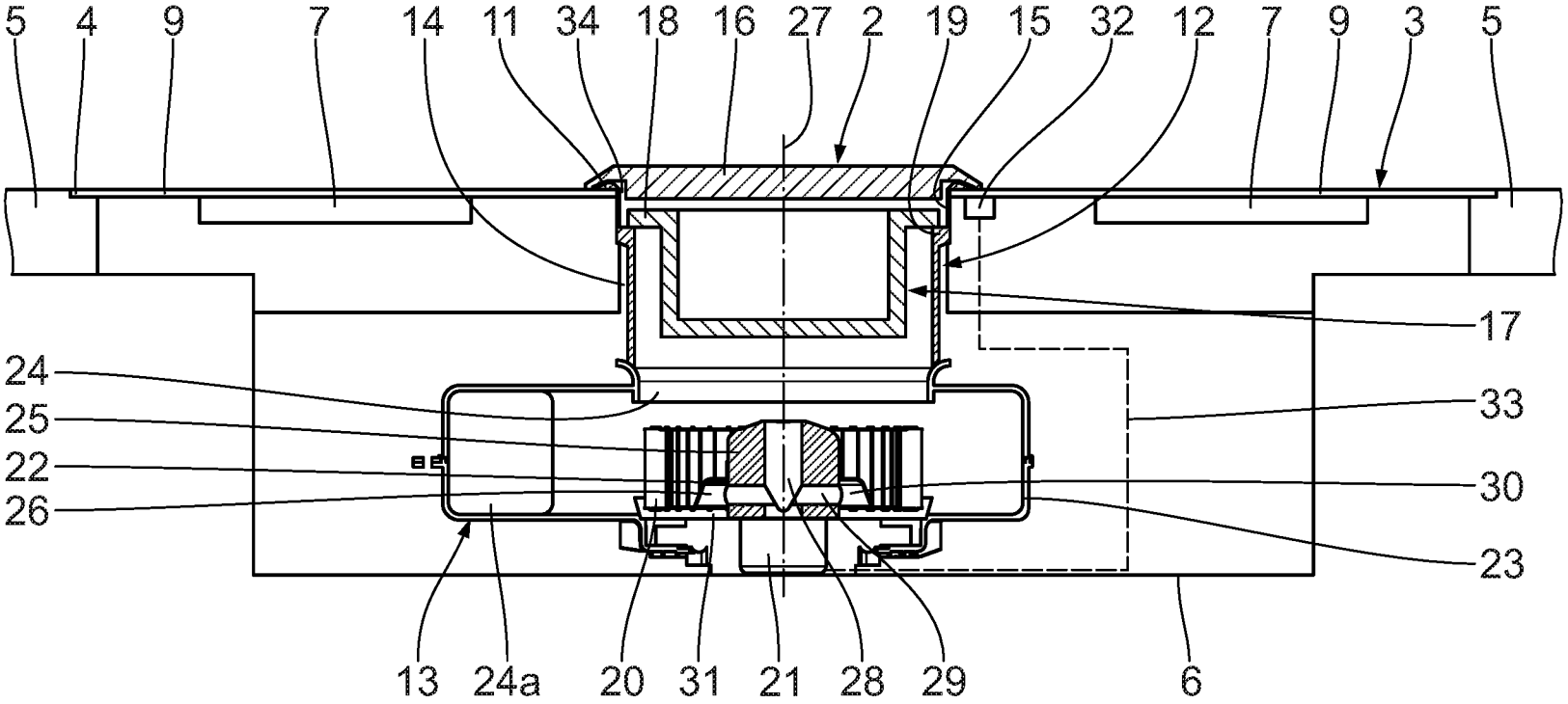
FIG. 2 shows a view in section of the stovetop system in FIG. 1, wherein a fan impeller is connected non-rotatably to a fan motor via a fan coupling.

The vapour extraction device 1 is shown in FIG. 2 in a ready-to-use state. The fan impeller 20 is arranged in the fan housing 23 and connected non-rotatably to the drive pin 25 via the drive bell housing 26. The locking means 28 is situated in a locking position in which the fan coupling 22 is locked. The fan impeller 20 is thus rigidly connected to the drive pin 25 along the axis of rotation 27. The grease filter insert 17 is arranged in the reduced-pressure duct section 14. The protective grating 16 is attached to the protective grating seat 34. By virtue of the attachment of the protective grating 16 to the protective grating seat 34, the supply of energy to the fan motor 21 is enabled by the circuit breaker 32. The collecting tray 31 is arranged below the fan impeller 20.

By activating the fan motor 21, a drive torque is applied to the rotatably mounted fan impeller 20 via the drive shaft and the fan coupling 22. The fan impeller 20 is set in rotational movement about the axis of rotation 27. As a result, a reduced pressure is generated in the region of the reduced-pressure duct section 14. The cooking vapours which occur above the stovetop panel 9 are extracted downward through the protective grating 16 into the inflow opening 15. The cooking vapours flow through the grease filter insert 17 in the region of the reduced-pressure duct section 14, wherein oil and grease are removed from the flow of cooking vapours by the grease filter insert 17. The cooking vapours thus purified pass into the fan housing 23 via the housing opening 24.

Solid or liquid constituents remaining in the cooking vapours can be deposited in the collecting tray 31. Some of these liquid or solid constituents of the cooking vapours also accumulate on the fan impeller 20. As a result, unpleasant smells can occur and the efficiency of the vapour extraction device 2 can be reduced. The fan impeller 20 can be removed from the fan housing 23 and the extraction duct 12 for cleaning purposes.

Figure 3:
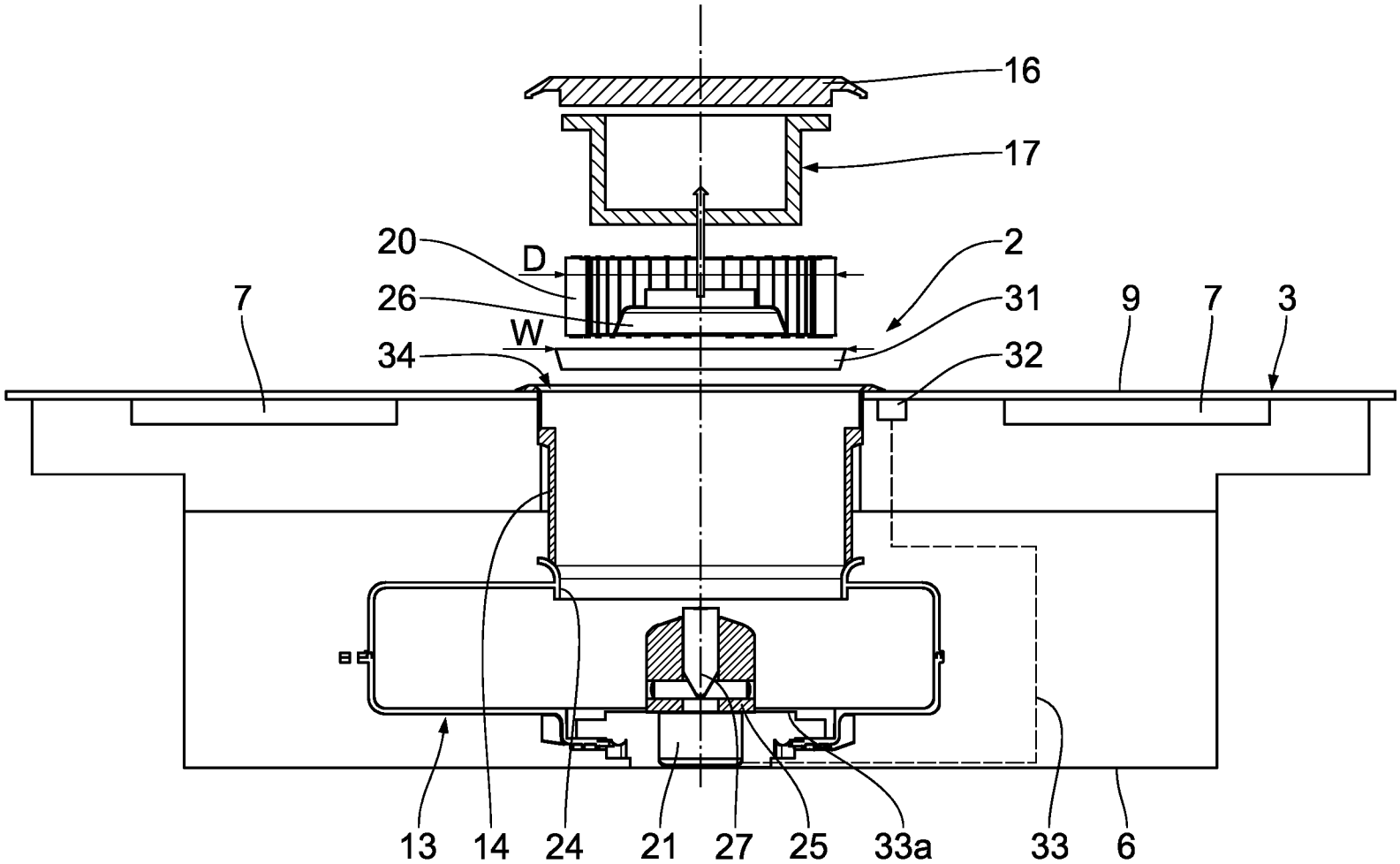
FIG. 3 shows a view in section of the vapour extraction device in FIG. 1, wherein the fan coupling is released and the fan impeller is removed upward from the extraction duct.
Figure 4:
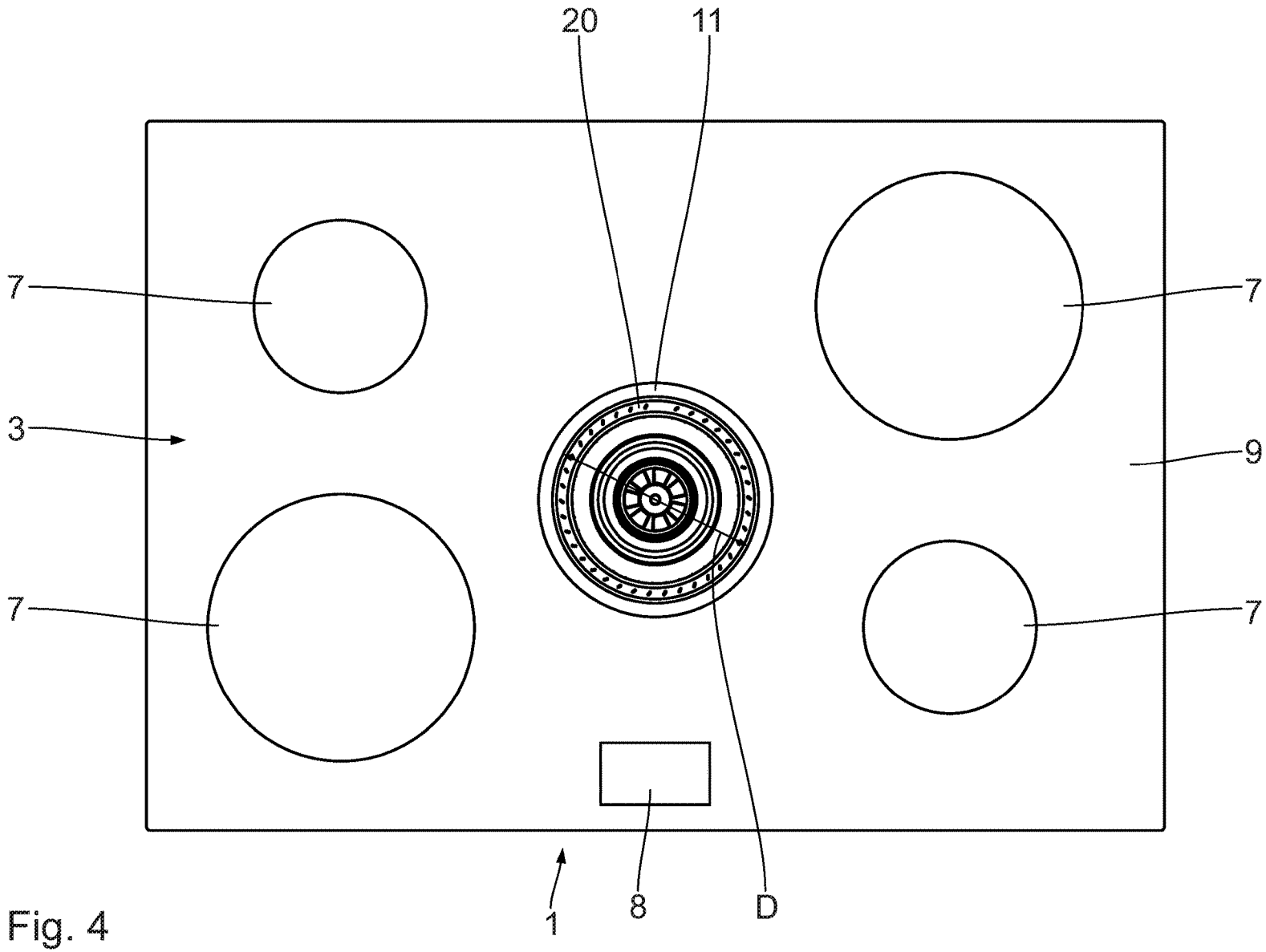
FIG. 4 shows a view from above of the stovetop system in FIG. 1.

The stovetop system 1 in a removed state is shown in FIG. 3. The fan motor 21 is deactivated via the control unit 8. The protective grating 16 is detached from the protective grating seat 34 and removed upward. The grease filter insert 17 is removed upward from the reduced-pressure duct section 14 through the inflow opening. The locking means 28 is situated in a release position, wherein the pins 29 are arranged completely inside the drive pin 25. The fan impeller 20 is thus displaced relative to the drive pin 25 in the direction of the axis of rotation 27. The fan impeller 20 is removed vertically upward from the fan housing 23 and the extraction duct 12 via the housing opening 24, the reduced-pressure duct section 14, and the inflow opening 15. The collecting tray 31 is likewise removed upward from the fan housing 23 and the extraction duct 12.

Because the protective grating 16 is detached from the protective grating seat 34, the circuit breaker 32 is activated. The supply energy of the fan motor 21 is interrupted by the circuit breaker 32. Activation of the fan motor 21 is thus not possible. The fan impeller 20 and the collecting tray 31 can be cleaned safely.

The collecting tray 31 and the fan impeller 20 is installed in the fan housing 23 in the reverse sequence to their removal. In the same way, the grease filter insert 17 is also replaced in the reduced-pressure duct section 14 and the protective grating 16 can be attached to the protective grating seat 34. The vapour extraction device 2 is thus restored to its ready-to-use state.

According to another exemplary embodiment (not shown) of the invention, the fan coupling 22 takes the form of a magnetic coupling. The drive bell housing 26 is here mounted so that it can rotate relative to the drive pin 25. The drive pin 25 is connected non-rotatably to the fan housing 23. The drive pin 25 takes the form of a stator and gas electrical conductive windings. The drive bell housing 26 takes the form of a rotor and comprises permanent magnets. When electrical energy is applied to the windings, the latter interact with the permanent magnets of the drive bell housing 26, as a result of which the drive torque is transmitted contactlessly to the fan impeller 20. Because there is no relative movement between the drive pin 25 and the fan housing 23, a seal can be made particularly robustly and safely between the fan housing 23 and the components of the fan motor 21 through which electrical current flows. The fan motor 21 is hereby, in the form of an external rotor motor, formed by the windings arranged in the drive pin 25 and the permanent magnets connected to the fan impeller 20.

The fan impeller 20 is mounted so that it can rotate on the drive pin 25. The drive impeller 20 can be detached from the drive pin 25 vertically upward along the axis of rotation 27. The stovetop system 1 according to the second exemplary embodiment functions in a manner which corresponds essentially to that according to the first exemplary embodiment.

Figure 5:
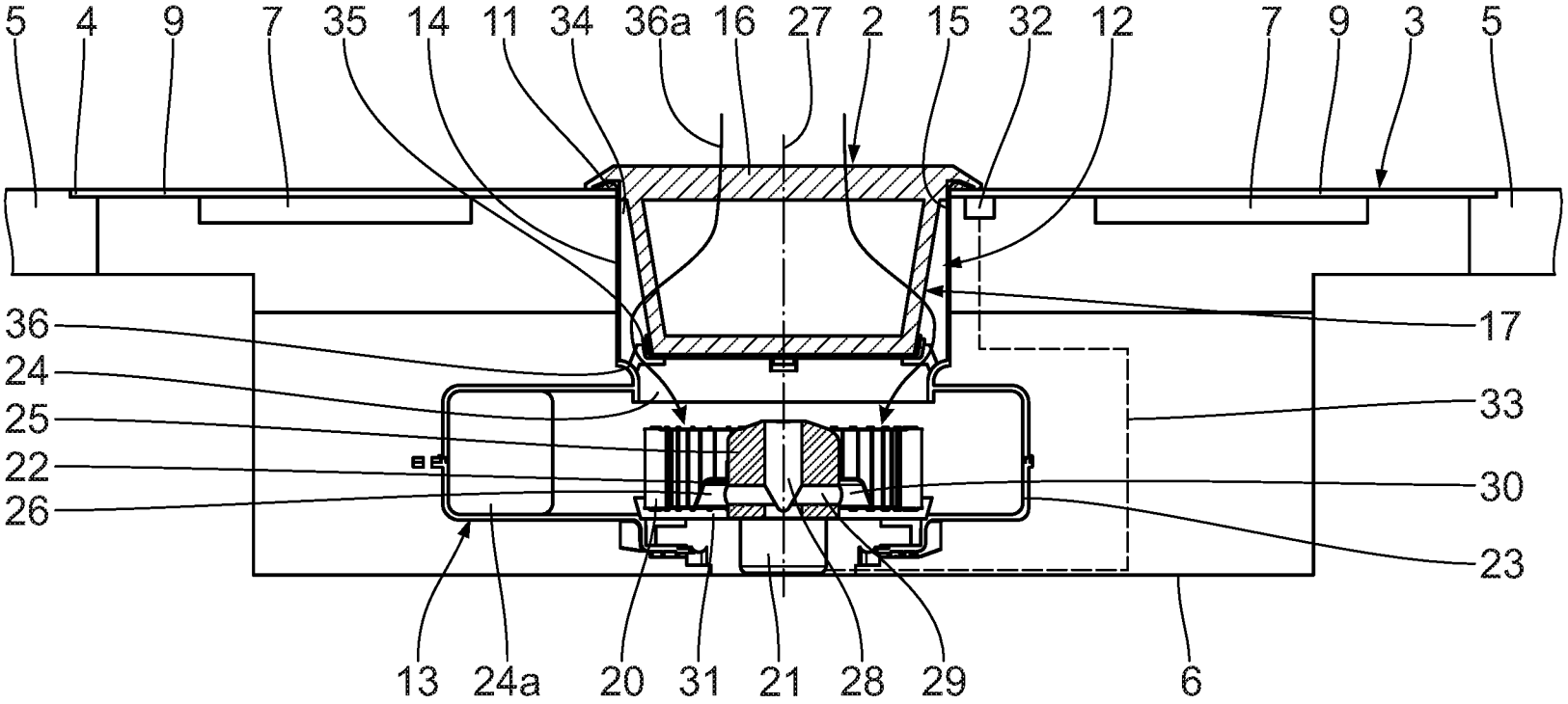
FIG. 5 shows a view in section of a stovetop system according to another exemplary embodiment, according to which a grease filter insert is arranged on a fan housing projection via a filter carrier and is integrally formed with the protective grating.

A further exemplary embodiment of the invention is described with the aid of FIG. 5. In contrast to the previous embodiment, the grease filter insert 19 is not attached to the reduced-pressure duct section 14 of the extraction duct 12 via the duct projection 19. The reduced-pressure duct section 14 is configured without a duct projection 19. The grease filter insert 17 is supported on a grease filter carrier 35. The grease filter carrier 35 is attached to a fan housing projection 36 of the fan housing 23. The filter carrier 35 has four carrier feet via which it is in contact with the fan housing projection 36. In addition, the filter carrier 35 has a central opening arranged in the region of the axis of rotation 27 and is thus designed to be permeable by cooking vapours. The filter carrier 35 is connected reversibly to the grease filter insert 17 and to the fan housing projection 36. The filter carrier 35 can, in the same way as the grease filter insert 17, be removed reversibly from the extraction duct 12, in particular from the reduced-pressure duct section 14 and through the inflow opening 15.

The grease filter insert 17 has a side wall which is permeable by cooking vapours. Cooking vapours can thus be sucked into the fan housing 23 through the side walls of the grease filter insert 17 and between the carrier feet of the filter carrier 35, according to the schematically indicated flow lines 36*a*. The grease filter insert 17 is connected gas-tightly to the reduced-pressure duct section 14 in its radially outer edge region.

Figure 6:
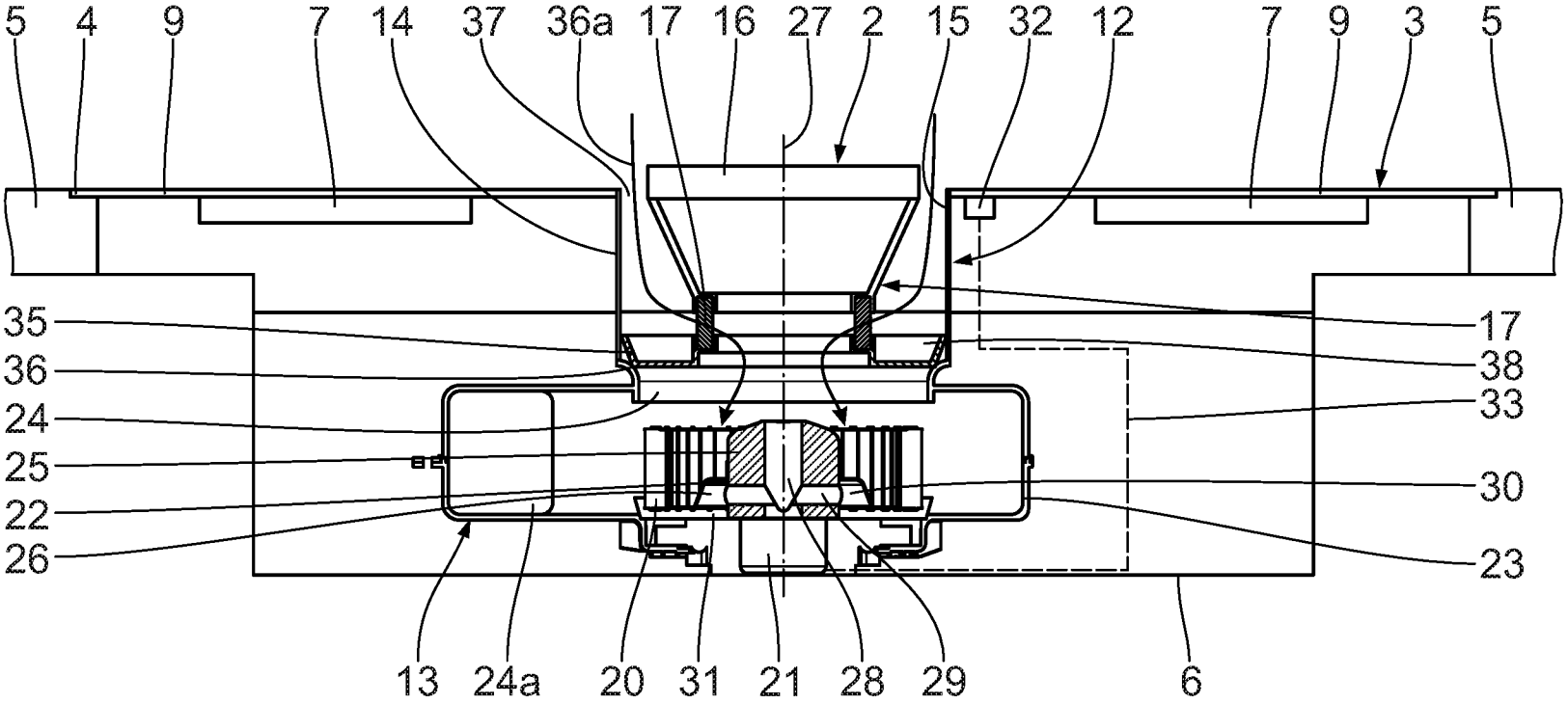
FIG. 6 shows a view in section of a stovetop system according to another exemplary embodiment, according to which the grease filter insert is arranged on the fan housing projection via a filter carrier and an inflow gap is configured between the protective grating and the inflow opening.

A further exemplary embodiment of the invention is described with the aid of FIG. 6. In contrast to the previous exemplary embodiments, the grease filter insert 17 has a circular cylindrical design and is attached gas-tightly to the fan housing projection 36 via the filter carrier 35. In addition, an inflow gap 37 is formed between the protective grating 16 and the inflow opening 15. The reduced-pressure duct section 14 does not have a duct projection 19. The filter carrier 35 is designed with no carrier feet and is connected gas-tightly to the grease filter insert 17 and the fan housing 23. The filter carrier 35 has a central opening which is permeable to cooking vapours. This central opening is arranged in the region of the axis of rotation 27. The filter carrier 35 comprises a carrier tray 38 which is arranged in a region of the filter carrier 35 which is situated radially on the outside with respect to the axis of rotation 27. The carrier tray 38 is configured to hold liquids.

The side wall of the grease filter insert 17 is configured to be permeable to cooking vapours. The protective grating 16 is attached to the grease filter insert 17. Cooking vapours which are sucked in by the fan impeller 20 pass via the inflow gap 37, according to the schematically indicated flow lines 36*a*, and from outside through the side wall of the grease filter insert 17, via the central opening of the filter carrier 35 and into the fan housing 23.

Both the grease filter insert 17 and the filter carrier 35 and the protective grating 16 can be removed reversibly upward from the extraction duct 12 m in particular through the inflow opening 15.

A further variant of the stovetop system 1 is described below with reference to FIGS. 7 and 8. Reference should be made to the preceding description of the other variants for the basic structure of the stovetop system 1.

In this variant, the motor 21 is coupled to the fan impeller 20 via a drive means, in particular a belt drive 40. The belt drive 40 comprises a first drive belt 41. The motor 21 is coupled to a direction-changing means 42 via the first drive belt 41. A rotatably mounted pin or cylinder, in particular a hollow cylinder, serves as the direction-changing means 42.

The direction-changing means 42 is coupled to the fan impeller 20 via a second drive belt 43.

A particularly flexible arrangement of the fan motor 21 relative to the fan impeller 20 is possible via the direction-changing means 42.

According to a variant not shown in the drawings, the fan motor 21 can also be connected to the fan impeller 20 directly via a drive belt.

According to another alternative not shown in the drawings, the fan motor 21 can be coupled to two, three, four, or more fan impellers directly or indirectly, in other words in particular via a direction-changing means 42. The fan impellers can hereby preferably be coupled to the fan motor 21 independently of one another.

Figure 7:
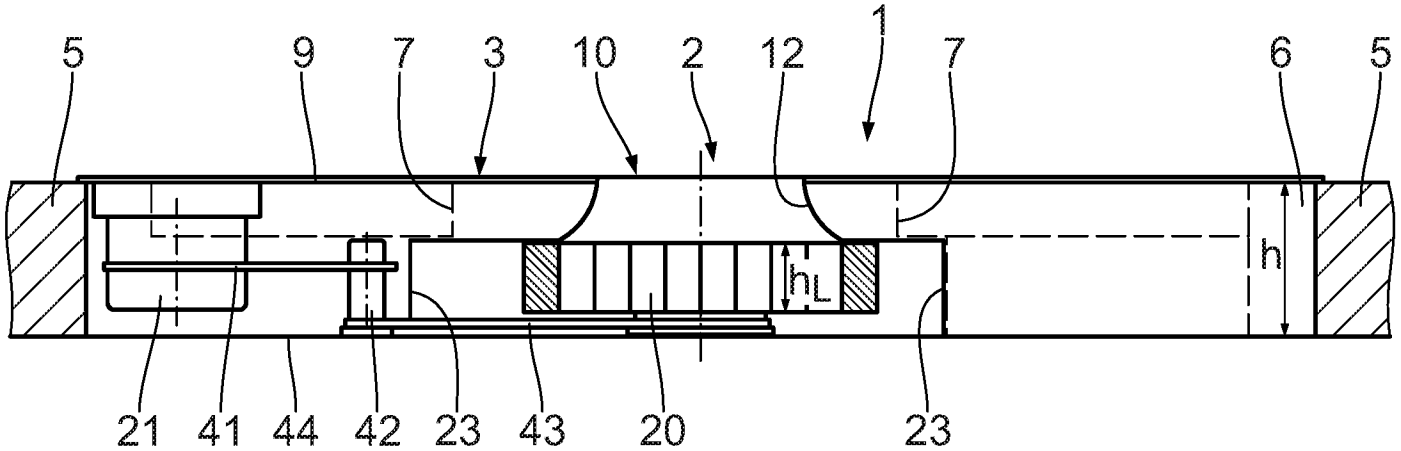
FIG. 7 shows a view in section of a stovetop system according to a further variant.
Figure 8:
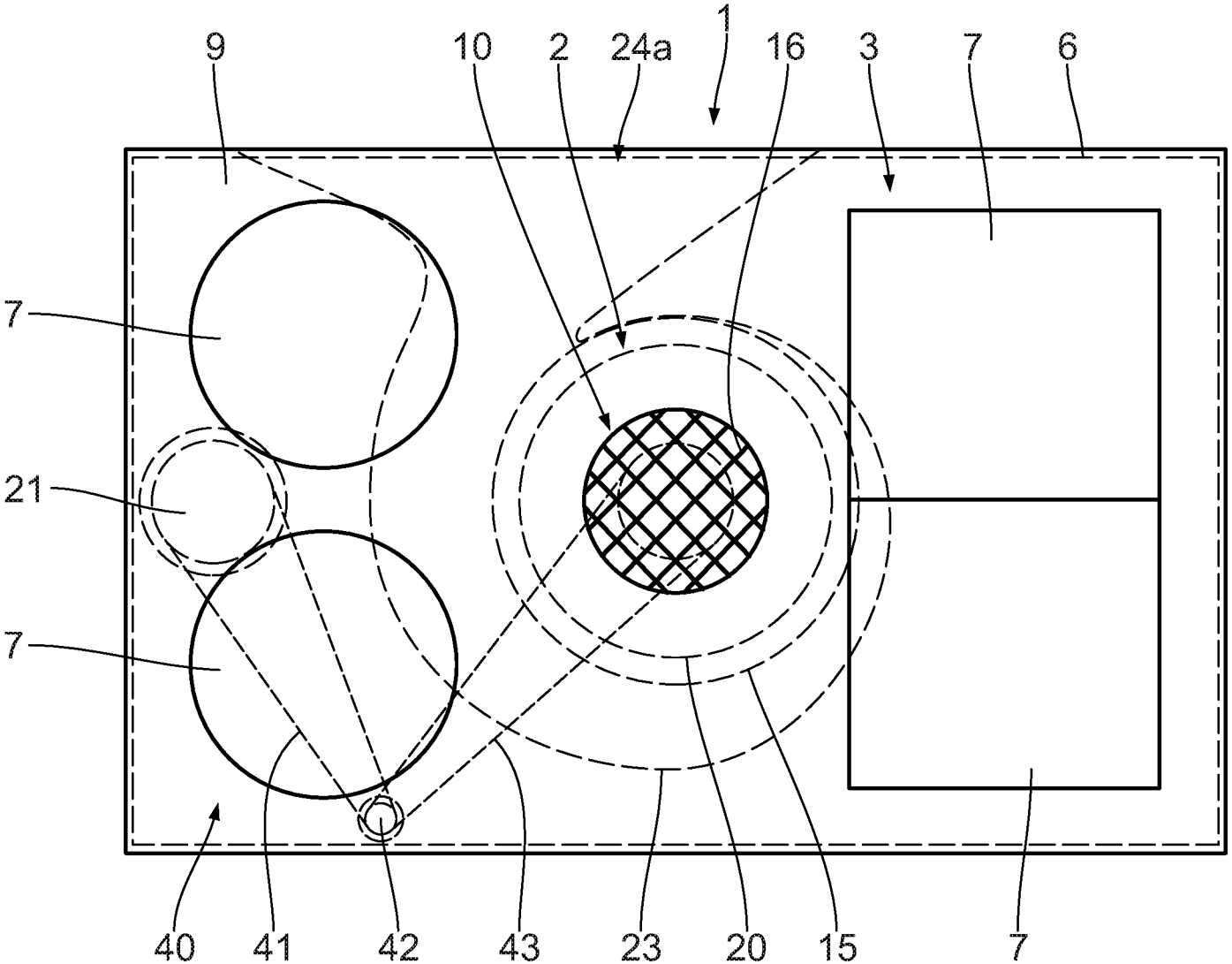
FIG. 8 shows a view from above of the stovetop system according to FIG. 7.

As can be seen by way of example in the schematic FIG. 7, the motor 21 can be arranged offset laterally with respect to the fan impeller 20. The motor 21 can be arranged in particular so that it vertically overlaps the fan impeller 20. It can in particular be arranged at the same height as the fan impeller. This enables a particularly compact design of the stovetop system 1, in particular a particularly low structural height h thereof. The structural height h of the stovetop system 1 is limited essentially by the height $h_L$ of the fan impeller 20 of the fan. The height $h_L$ of the fan impeller is in particular no more than 10 cm, in particular no more than 8 cm, in particular no more than 6 cm, in particular no more than 5 cm, in particular no more than 4 cm.

The total structural height h of the stovetop system 1 can be 5 cm or less. It has proven to be the case that it is even possible to design a stovetop system 1 with an integrated vapour extraction device having a total structural height h of 4 cm. In general, the total structural height h of the stovetop system 1 is no more than 25 cm, in particular no more than 20 cm, in particular no more than 15 cm, in particular no more than 11 cm, in particular no more than 8 cm, in particular no more than 5 cm.

The motor 21 is arranged so that it is suspended. It is in particular suspended from the stovetop panel 9. It can also be arranged on a housing element of the stovetop system 1, for example on a housing element of a housing for holding the stovetop electronics. This makes it possible to mechanically decouple the motor from the stovetop panel 9.

A gap, in particular in the form of an open space, is arranged between the motor 21 and a base 44 of the system housing 6. This results in a higher degree of safety, in particular to resistance of the stovetop system 1, in particular of the motor 21, to liquid which might possibly penetrate the system housing 6. The gap between the motor 21 and the base 44 of the system housing 6 can in particular be at least 1 cm.

According to an alternative not shown, the motor can also be attached so that it stands upright.

According to another alternative not shown in the drawings, the fan impeller 20 is arranged essentially directly below the inflow opening 15. The gap between an upper edge of the fan impeller 20 and an underside of the stovetop panel 9 is in particular no more than 3 cm, in particular no more than 2 cm, in particular no more than 1 cm. As a result, an even more compact design of the stovetop system 1 is enabled, in particular an even smaller structural height h thereof.

In this alternative, a plurality of fan impellers 20 can advantageously be provided. The fan impellers 20 can be arranged in the regions between the cooking zones 7. In particular in the case of an arrangement of a plurality of fan impellers 20 in the region between the cooking zones 7, the individual fan impellers 20 can advantageously have a compact design. They can in particular have an external diameter of no more than 250 mm, in particular no more than 200 mm, in particular no more than 160 mm, in particular no more than 150 mm, in particular no more than 130 mm, in particular no more than 120 mm, in particular no more than 100 mm.

In the case of a plurality of fan impellers 20, each individual fan impeller 20 can advantageously be removed reversibly from the stovetop system 1 via an inflow opening 15. An individual separate inflow opening 15 can hereby be associated with each of the fan impellers 20.

The invention claimed is:

1. A vapour extraction device for extracting cooking vapours downward, comprising an extraction duct for conducting the cooking vapours, a fan apparatus for sucking in the cooking vapours having a rotatably drivable fan impeller which is configured to be arranged in the extraction duct, a fan motor for supplying a drive torque, and a releasable fan coupling for transmitting the drive torque to the fan impeller, wherein the fan impeller is removable from the extraction duct via an inflow opening, and wherein the fan apparatus has a sealing means for liquid-tightly sealing the fan motor with respect to the extraction duct, and a collecting tray for holding liquids, wherein the collecting tray is removable from the extraction duct through the inflow opening.

2. The vapour extraction device as claimed in claim 1, wherein the fan motor is arranged outside the extraction duct.

3. The vapour extraction device as claimed in claim 1, wherein the fan motor is arranged in a direction perpendicular to an axis of rotation at a distance from the fan impeller.

4. The vapour extraction device as claimed in claim 1, wherein the fan impeller is coupled contactlessly to the fan motor via at least one of the group comprising a gearing mechanism and a belt drive.

5. The vapour extraction device as claimed in claim 1, wherein the fan impeller is removable from the extraction duct without using tools.

6. The vapour extraction device as claimed in claim 1, wherein the fan coupling is a magnetic coupling.

7. The vapour extraction device as claimed in claim 1, wherein the fan coupling has a locking means which is movable between a release position and a locking position, wherein the fan coupling can be released only in the release position of the locking means.

8. The vapour extraction device as claimed in claim 1, wherein the collecting tray is attached to the fan impeller.

9. The vapour extraction device as claimed in claim 1, wherein the fan impeller is designed to be dishwasher-safe.

10. The vapour extraction device as claimed in claim 1, comprising a protective grating, for protecting against people reaching into the fan impeller, which is reversibly attachable to a protective grating seat upstream from the fan impeller.

11. The vapour extraction device as claimed in claim 10, wherein the protective grating has a grease filter insert.

12. The vapour extraction device as claimed in claim 1, comprising a circuit breaker, connected to an energy supply of the fan motor, for interrupting the operation of the fan motor.

13. The vapour extraction device as claimed in claim 12, wherein the circuit breaker is arranged for the purpose of detecting the attachment of the protective grating to the protective grating seat, wherein the operation of the fan motor is interruptible when the protective grating is not attached to the protective grating seat.

14. A stovetop system comprising at least one vapour extraction device as claimed in claim 1, and at least one stovetop with at least one cooking zone for heating food.

15. The stovetop system as claimed in claim 14, wherein the vapour extraction device has a total structural height of no more than 11 cm.

16. A vapour extraction device for extracting cooking vapours downward, comprising an extraction duct for conducting the cooking vapours, and a fan apparatus for sucking in the cooking vapours having a rotatably drivable fan impeller which is configured to be arranged in the extraction duct, a fan motor for supplying a drive torque, and a releasable fan coupling for transmitting the drive torque to the fan impeller, wherein the fan impeller is removable from the extraction duct via an inflow opening, and wherein the fan impeller is designed to be dishwasher-safe.

17. A vapour extraction device for extracting cooking vapours downward, comprising an extraction duct for conducting the cooking vapours, a fan apparatus for sucking in the cooking vapours having a rotatably drivable fan impeller which is configured to be arranged in the extraction duct, a fan motor for supplying a drive torque, and a releasable fan coupling for transmitting the drive torque to the fan impeller, and a protective grating, for protecting against people reaching into the fan impeller, which is reversibly attachable to a protective grating seat upstream from the fan impeller, wherein the fan impeller is removable from the extraction duct via an inflow opening.

* * * * *